United States Patent [19]

Kotoyori

[11] 4,367,876

[45] Jan. 11, 1983

[54] SCORE DISPLAY APPARATUS FOR PINBALL GAME MACHINES AND DISPLAY METHOD THEREFOR

[75] Inventor: Yukio Kotoyori, Nihonbashi, Japan

[73] Assignee: Kabushiki Kaisha Universal, Oyama, Japan

[21] Appl. No.: 129,652

[22] Filed: Mar. 12, 1980

[30] Foreign Application Priority Data

Mar. 12, 1979 [JP] Japan ..... 54-27706

[51] Int. Cl.[3] ..... A63F 7/40; A63F 9/22

[52] U.S. Cl. ..... 273/121 A; 273/DIG. 28

[58] Field of Search ..... 273/54 C, 85 G, 313, 273/1 GC, 1 E, DIG. 28, 121 A; 364/410; 340/323 R, 323 B, 726, 731; 235/92 GA

[56] References Cited

U.S. PATENT DOCUMENTS

| | | | |
|---|---|---|---|
| 3,874,669 | 4/1975 | Ariano et al. | 273/DIG. 28 |
| 3,889,253 | 6/1975 | Ross | 273/54 C |
| 4,026,555 | 5/1977 | Kirschner et al. | 273/85 G |
| 4,093,232 | 6/1978 | Nutting et al. | 273/121 A |
| 4,107,665 | 8/1978 | Mayer et al. | 340/731 |
| 4,107,786 | 8/1978 | Masaki et al. | 340/731 |
| 4,131,948 | 12/1978 | Kaenel | 273/54 C |
| 4,197,590 | 4/1980 | Sukonick | 340/726 |
| 4,198,051 | 4/1980 | Bracha et al. | 273/121 A |
| 4,296,930 | 10/1981 | Frederiksen | 273/DIG. 28 |

OTHER PUBLICATIONS

*Gunfight Midway Computer Service Manual;* available as of 1977; pp. 5–7.

*Primary Examiner*—Vance Y. Hum
*Attorney, Agent, or Firm*—Young & Thompson

[57] ABSTRACT

A pinball game machine is provided with a CRT (Cathode Ray Tube) visual display unit for indicating simultaneously scores in digital display corresponding to each of the players who are playing at one time. A player-related total score operated by a micro-computer is indicated on the screen of the CRT visual display unit in digital display. Upon using the CRT visual display unit, total scores, each of them corresponding to each of a plurality of players, may be simultaneously indicated. In this display, the score indication of the player who is up is performed using large digits so as to enable players to distinguish it easily from the scores of the other players.

8 Claims, 9 Drawing Figures

(a)

1ST PLAYER
52070
2ND 10050
3RD 21040

(b)

2ND PLAYER
10050
3RD 21040
1ST 55010

(c)

3RD PLAYER
21040
1ST 55010
2ND 24100

1ST PLAYER
52070
2ND 10050
3RD 21040
PLAYING BALL 1
NUMBER MATCH 40
CREDIT 0

SCORE DISPLAY APPARATUS FOR PINBALL GAME MACHINES AND DISPLAY METHOD THEREFOR

BACKGROUND OF THE INVENTION

The present invention relates to score display apparatus for use in pinball game machines and a display method therefor, more particularly to such score display apparatus and a display method in which a CRT visual display unit is provided in a part of a pinball game machine to indicate several scores of players in digital display.

Various types of pinball game machines with a microcomputer built in for controlling automatically the actions of many movable components, associated circuits and elements and performing the scoring operation for the player who is up, are already known. One of them, for example, disclosed in Japanese Patent Appln. Disclosure No. 52-64325 (corresponding to U.S. patent application Ser. No. 633,470, filed November, 1975), is provided with four score indicators so as to enable four players to compete with each other and to indicate simultaneously four player-related scores. Such indications are respectively comprised of six transversely aligned digit elements to display to six figures of a number, each of which elements is completed segmentally by seven light-emitting diodes. Other pinball game machines on the market are provided with six score indications so as to enable six players to compete with each other in games.

Generally, the score indicator utilizing a plurality of seven-segment digit elements is at a disadvantage from the viewpoint of manufacture and cost thereof, because it requires the same number of indicators as the number of players that can play at one time.

Thus, when the score display apparatus indicates six player-related scores to be numbers of six figures, then six score indicators, thirty six latch means and thirty six recorders will be basically required. Although a dynamic driving system will be utilized, fourty five signal lines will be further required to drive these indicators. This results in making the wiring operation very troublesome. Furthermore, it is difficult to reorganize the score display apparatus in such a case as it is desirable to increase the number of players that can play at one time. Furthermore, the score display apparatus using such indicators cannot be adapted to provide information relative to games without score information. Therefore, the conventional score display apparatus has not found wide application.

OBJECTS OF THE INVENTION

It is accordingly a principal object of the present invention to provide score display apparatus for use in pinball game machines which may be manufactured easily and inexpensively.

It is another object of the present invention to provide score display apparatus for use in pinball game machines which permits multipurpose applications such as providing various information relative to the games as well as scoring indications.

It is still another object of the present invention to provide score display apparatus for use in pinball game machines which may be easily reorganized as desired, with only the modification of softwear when it is desirable to change the number of players that can play at one time.

Finally, it is an object of the present invention to provide a score display method for pinball game machines in which the score indication of the player at play is performed using large-size digits so as to enable the players to distinguish it easily from the scores of the other players.

SUMMARY OF THE INVENTION

The present invention is particularly concerned with such score apparatus for use in pinball game machines wherein the data is transferred from a micro-computer for operating scores and the like into a memory means to be memorized and then each memory cell of the memory means is sequentially accessed to read out the data. The data read-out is transferred to a CRT visual display unit for displaying information comprising characters and digits after the conversion into video signals.

In the case of a plurality of players playing at one time, the score of the player at play is displayed with large-size digits on a predetermined special portion of the screen of the CRT visual display unit. By virtue of this, the score display position for each player is interchanged one after another when the player to operate the pinball game machine takes the place of the player whose play is finished.

The score display apparatus using the CRT visual display unit in accordance with the present invention may provide various information on the CRT visual display unit such as game operation manners, the number of games playable, warning of accidents and the like, as well as scoring information.

The score display apparatus in accordance with the present invention basically comprises a CRT visual display unit already on the market, a display RAM (random access memory), a timing generator, a pattern ROM (read only memory) and a mixer, so that it is less expensive than conventional score indicators using six digit elements in seven segments. In addition, the score display apparatus using the CRT visual display unit serves to make wiring operations easily and to lower the cost, because a group of elements from the display RAM to the mixer circuit may be disposed on a single base panel and the connection between the mixer circuit and the CRT visual display unit is completed by at least two signal transmission lines.

BRIEF DESCRIPTION OF THE DRAWINGS

The accompanying drawings illustrate a preferred construction of the present invention in which the above objects, advantages and features are more clearly illustrated as well as others which will be readily understood from the following description.

In the drawings.

DETAILED DESCRIPTION OF THE INVENTION

Figure 1:
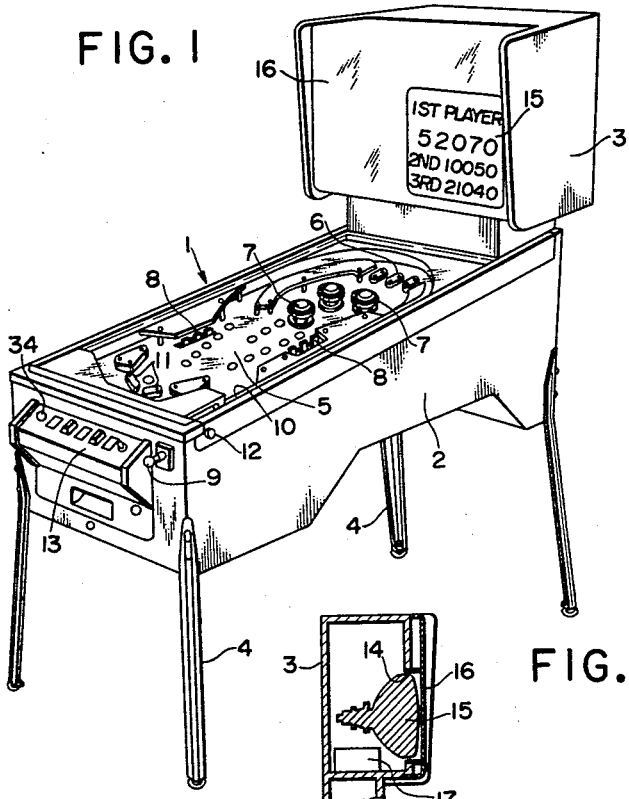
FIG. 1 is a perspective view of a pinball game machine in accordance with the present invention.

Referring to the drawings and particularly to FIG. 1 thereof, there is shown a pinball game machine 1 having a cabinet 2 for a playing field and a cabinet 3 for a CRT (Cathode Ray Tube) visual display unit. The cabinet 2 has playing field 5 therein and has four legs 4 secured to the underside thereof which support the cabinet 2 to be located appropriately at waist height of the usual game player. In accordance with the usual construction, the playing field 5 includes a plurality of partitions 6 forming passageways for a round ball, a plurality of kicker devices 7 for striking and driving the round ball across the playing field and targets 8, all located within the playing field 5. In such pinball game machines, when special passageways are passed through by the ball, and when the kickers and the targets are engaged by the ball, various scores are established.

The manually operable lever 9 of the ball-feeding mechanism is biased by a spring, not shown, so the player can play the ball by the releasing manually the lever, in the usual way. The ball, driven to the upper end of the playing field 5 by the lever, through passageway 10, rolls downward under the force of gravity across the playing field which is inclined downwardly. During this rolling movement, when the elements such as kickers 7 and targets 8 are engaged by the ball, the switches incorporated in these elements are actuated to provide additional scoring. Further scoring switches are appropriately disposed within particular passageways and establish various scores when engaged by the ball passing through the passageway, all in a well known and conventional manner.

In accordance with the usual construction, the pinball game machine also includes a pair of manually operated or controlled flippers 11 pivotally mounted at the bottom portion of the playing field. The flippers 11 engage the ball and return it upwardly on the playing field 5. The flipper controls are conventionally in the form of right and left buttoms 12 provided on the corresponding side walls of the cabinet 2 for manual operation by the operator. Between these flippers there is defined a space, which is substantially twice as large as the diameter of the ball, to permit the ball to pass through. When the ball passes through the space with the result of finishing the game or a portion of the game, the ball activates a switch to render the pinball game machine inoperable. When the ball is returned again to the initial position from which it was ejected, then the game can continue.

In addition, a coin-receiving means is provided to condition the playing of the game on the introduction of coins. In the illustrated embodiment of the invention, the reference numeral 13 indicates a coin selector which can differentiate a genuine coin of the proper denomination, from others. Introduction of the coins into the coin selector 13 will turn on a coin switch and will condition the pinball game machine to be operable, for example for first and second players with the response providing for automatic and alternate playing and scoring for the two players.

Figure 2:
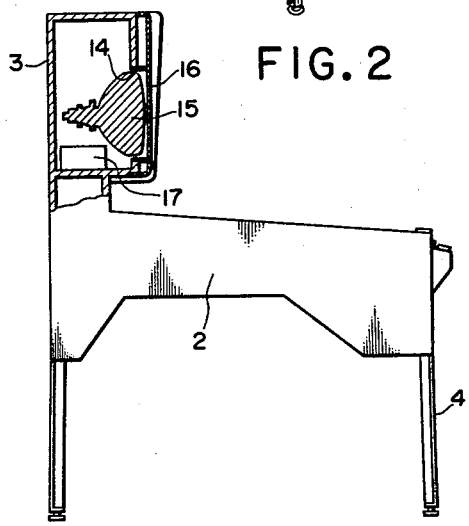
FIG. 2 is a side elevational view of a pinball game machine in accordance with the present invention, showing the CRT visual display unit in section.

As illustrated in FIG. 2, the cabinet 3 including a CRT visual display unit is formed with an opening 14 within which the CRT visual display unit 15 is appropriately received. The cabinet 3 is also provided with a transparent glass plate 16 which may close the front surface of the casing and through which the images displayed on the screen of the CRT visual display unit may be observed. Further, in the bottom portion of the CRT visual display unit cabinet 3, a control circuit system such as a microcomputer or the like is enclosed.

Figure 3:
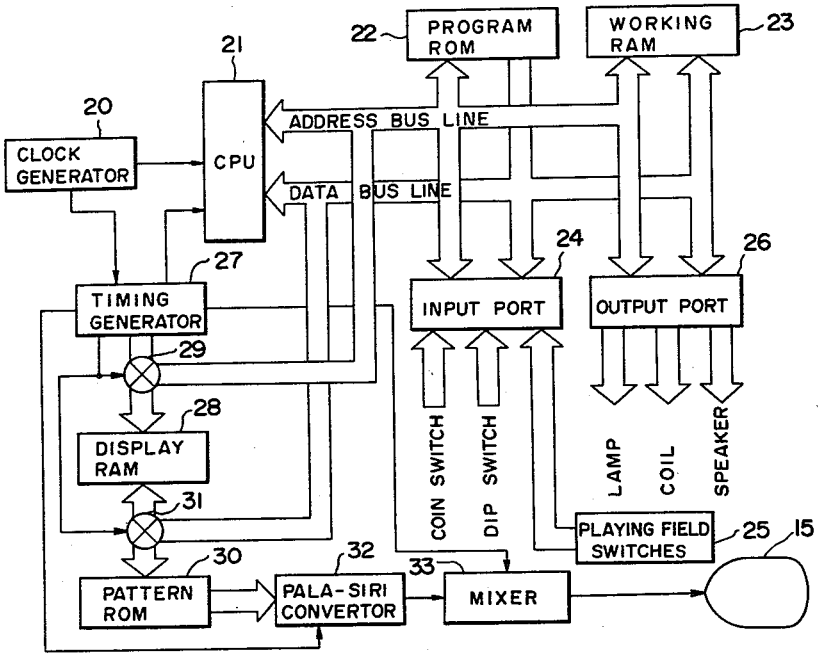
FIG. 3 is a block diagram showing the electric circuit embodying a score display apparatus with the CRT visual display unit in accordance with the present invention.

Referring now to FIG. 3, there is illustrated a preferred embodiment of the control circuit system in accordance with the present invention in which the clock signals from a clock generator circuit 20 are transmitted into a conventional CPU (central processing unit) 21. In a program ROM 22 is stored programs such as the scoring operation, the display operation and instructions of controlling and operating associated elements of the pinball game machine. A working RAM 23 is provided, to memorize temporarily the controlling and operating data. An input port 24 receives signals from a dip-switch and so forth, and from a plurality of playing field switches 25 disposed on the playing field for scoring and for resetting the condition of the game. Furthermore, an output port 26 is connected with target score lamps included in the playing field 5 which are operated when the target 8 is engaged, and with solenoids or solenoid coils incorporated in the kicker 7, a voice or sounds speaker and so forth. The micro-computer is basically comprised by the clock generator circuit 20, CPU 21, the program ROM 22, the working RAM 23, the input port 24 and the output port 26.

The clock signal from the clock generator circuit 20 is transmitted to the timing generator circuit 27 in which horizontal synchronizing signals, vertical synchronizing signals, address signals for the display RAM and the like may be established.

The location of the display RAM 28 in which the data from the working RAM 23 is stored is addressed by the CPU 21. Upon reading the data from the display RAM 28, it is addressed by the instruction signal from the timing generator circuit 27 and the data stored therein is immediately read out. In this way, the display RAM 28 may be addressed either by the timing generator circuit 27 or by the CPU 21, so that a selector means 29 is provided across its address bus line so as alternatively to change over the address operation from one to the other with the signal from the timing generator circuit 27.

Also to the display RAM 28 is, on the one hand, transferred the data from the working ROM 23, on the other hand transfers the read-out data into the pattern ROM 30. In this embodiment, a circuit means such as a character generator may be utilized as the pattern ROM. For that reason, another selector 31 is provided across its data bus line.

In the pattern ROM 30 various character data such as alphabet letters, large size digits and small size digits are memorized. Character data memorized in the pattern ROM 30 are addressed and read out by the address signal from the display RAM 28, and then the character data are converted to series signals through a parallel-serial converter circuit 32. The series signals are transferred to a mixer circuit 33 by which disuse signals for a blanking period are cleared. The video signals output from the mixer 33 is transferred to the CRT visual display unit displaying the player's score, various information on the game, and other information.

Figures 4, 5, 6:
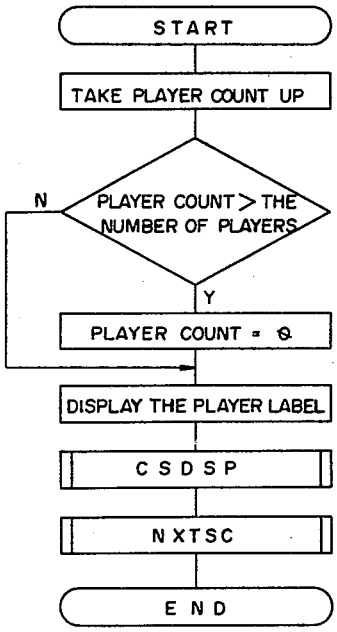
FIGS. 4 and 5 are diagrammatic illustrations of television screens on which various information is displayed.
FIGS. 6 to 8 are flow charts of the program and the sub-program representing sequences for displaying the scores of players.

FIG. 4 illustrates configurations of the display of scores on the screen of the CRT visual display unit. One play of the game will be over when the ball passes through the space between flippers 11 and falls down. Introduction of one coin (for example a quarter) into a coin acceptor (not shown) will condition the pinball game machine for one player to play three games (the operation of a dip switch may change the play to five games).

In the preferred embodiment of the present invention, the introduction of three coins into a coin acceptor and three operations of a start buttom 34 may condition the pinball game machine for three players to play at one time.

FIG. 4(*a*) illustrates a score indication pattern displayed on the screen of the CRT visual display unit, in which it is indicated that the first player is at play and his current total score is "52070." The score of the first player is indicated in large-size digits at the top of the screen, and the scores of the others are indicated in order, in the lower portion thereof.

When the one play of the game of the first player is over, the scores of the second and third players move up. The score of the current player is of course indicated in large-size digits and the others in small-size digits. Thus, the score of the first player is indicated under the third player's score, as shown in FIG. 4(*b*).

Furthermore, when the play of the second player is over, the indications of scores are advanced in like manner as shown in FIG. 4(*c*). In this way, the players can not only play three games but also compete with each other as to total score.

Another preferred embodiment of the present invention is shown in FIG. 5, in which there are provided indications such as repeatable games and other information in addition to the score indications. The signal of "PLAYING BALL" under the lowermost score indication means the repeatable games, that is, in the case shown in FIG. 5, the number of the play for the first player. The legend "NUMBER MATCH" means that one additional game play will be given to the player who has the score with the last two digits the same as the number randomly indicated on this line when all of the games are terminated. Furthermore, the legend "CREDIT" means the number of coins still unused in the coin acceptor.

The flowchart shown in FIG. 6 illustrates the program representing the procedure by which the indication of the player who is up is changed. The program will be run in response to the fall of the ball through the passageway between the flippers. The player indicated takes the place of a prior player. Now the relationship between the player count and the player may be given by the following table:

| Player Count | Player |
|---|---|
| 0 | 1st player |
| 1 | 2nd player |
| 2 | 3rd player |
| 3 | 4th player |
| 4 | 5th player |
| 5 | 6th player |

Figure 7:
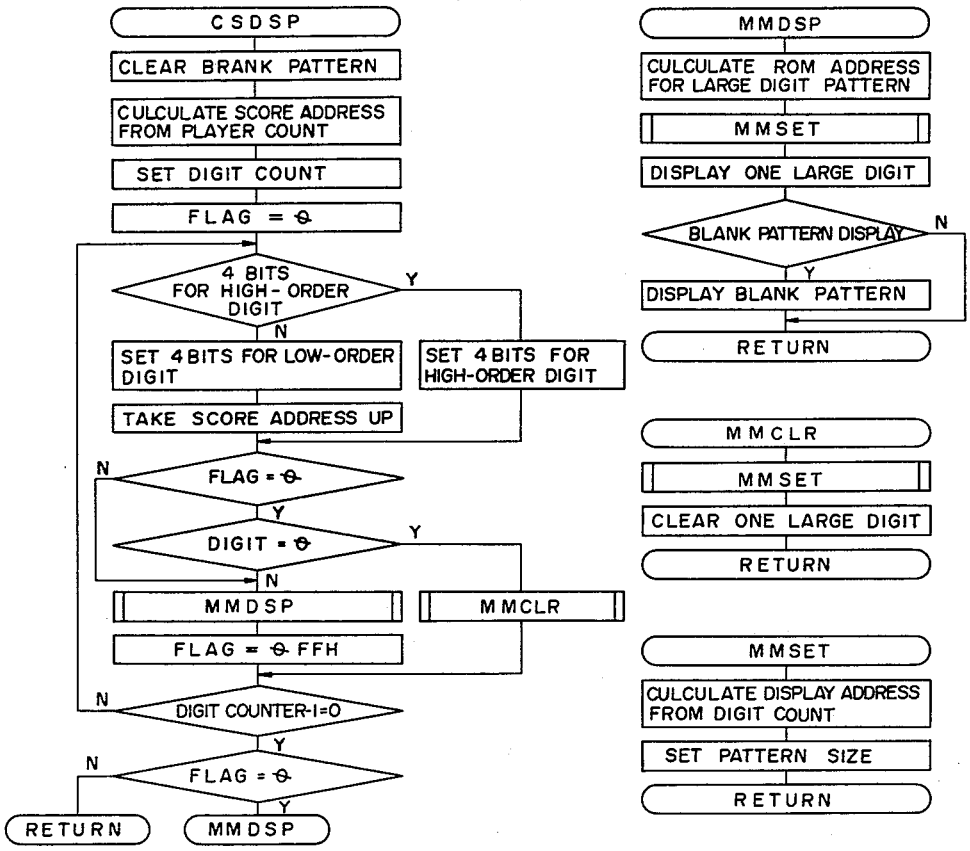

The flow charts shown in FIG. 7 illustrate sub-routine programs representing the procedures by which the score of the player who is up is indicated with large-size digits.

Figure 8:
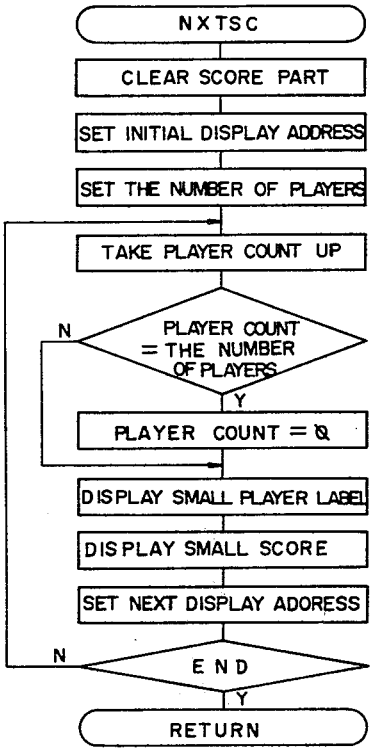

FIG. 8 illustrates the flow chart of the sub-routine programs representing the procedure to indicate the scores of the other players with small-size digits.

Figure 9:
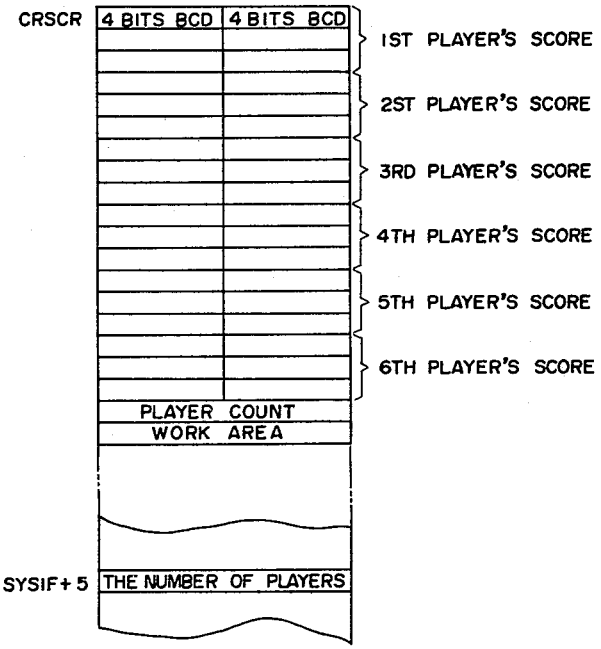
FIG. 9 is a diagrammatic illustration showing a part of the working RAM memory table.

FIG. 9 illustrates a part of the working ROM memory table in which three words are applied to each score of the players and six scores are carried therein.

What is claimed is:

1. A pinball game machine comprising a casing containing a playing field providing circuitous paths for a ball rolling on the playing field a micro-computer for controlling various mechanisms and elements of the apparatus and computing scores, a memory means for memorizing data from said micro-computer at the locations corresponding to the positions on the screen of a CRT visual display unit at which the indications representing said data are displayed, a read-out means to address and sequentially access said locations of said memory means for reading out said data at said locations, a video signal generating means which forms video signals based on said data which have been read out by said read-out means, a CRT visual display unit displaying scores on the screen when said video signals from said video signal generating means have been transferred into said CRT visual display unit, with the score of the player who is up being displayed in large-size digits and the other scores in small-size digits, and means connected to said score-displaying unit for providing said large- and small-size digits.

2. Apparatus as claimed in claim 1, said read-out means being a timing generator circuit.

3. Apparatus as claimed in claim 1, said memory means including a data selector means disposed in its address bus line, said data selector means alternately interconnecting said memory means with said micro-computer and said timing generator circuit through said address line depending on read/write signals from said timing generator circuit.

4. Apparatus as claimed in claim 1, said video signal generator means comprising a pattern ROM which generates character signals, the locations of said pattern ROM in which said character signals are stored being addressed in response to the data from said memory means, a parallel-serial converter circuit converting the pattern data from said pattern ROM into series signals, the conversion being controlled by the output signals from said timing generator circuit, and a mixer mixing input signals comprising horizontal synchronizing signals and vertical synchronizing signals from said timing generator circuit.

5. A method for operating pinball machines having the steps of including a casing containing a playing field providing circuitous paths for a ball rolling on the playing field, providing a micro-computer for computing the scores of a plurality of players and providing a CRT visual display unit on which the scores computed by the micro-computer are displayed, said steps further comprising computing in said micro-computer the score of the player who is up according to the circuitous path followed by a ball about said playing field as directed by the player who is up, and simultaneously displaying the scores of a plurality of players by said CRT visual display unit with the score of the player who is up displayed in large-size digits and the other scores in small-size digits.

6. A score display method as claimed in claim 5, and shifting the position of the score indication in order every time a subsequent player takes the place of the previous player so as to position the score of the player who is up at a predetermined position on the screen of said CRT visual display unit.

7. A score display method as claimed in claim 6, wherein the score of the player who is up is on the upper portion of the screen of said CRT visual display unit.

8. In a pinball machine including a casing containing a playing field providing circuitous paths for a ball rolling on the playing field and a micro-computer for computing the scores of a plurality of players and a CRT visual display unit on which the scores computed by the micro-computer are displayed; the improvement comprising means for computing in said micro-computer the score of the player who is up according to the circuitous path followed by a ball about said playing field as directed by the player who is up, means for simultaneously displaying the scores of a plurality of players by said CRT visual display unit with the score of the player who is up displayed in large-size digits and the other scores in small-size digits and means connected to said score displaying means for providing said large- and small-size digits.

* * * * *